US005458414A

United States Patent [19]

Crump et al.

[11] Patent Number: 5,458,414

[45] Date of Patent: Oct. 17, 1995

[54] METHOD AND APPARATUS FOR STORING AND HANDLING WASTE WATER SLURRIES

[75] Inventors: James M. Crump, Elburn; Bruce K. Doyle, Jr., St. Charles, both of Ill.

[73] Assignee: Great Lakes Aqua Sales and Service, Inc., St. Charles, Ill.

[21] Appl. No.: 385,588

[22] Filed: Feb. 8, 1995

Related U.S. Application Data

[63] Continuation of Ser. No. 275,922, Jul. 14, 1994, abandoned, which is a continuation of Ser. No. 879,602, May 7, 1992, abandoned.

[51] Int. Cl.[6] ..... B01F 5/10

[52] U.S. Cl. ..... 366/137; 366/263; 366/292

[58] Field of Search ..... 366/136, 137, 366/165, 173, 262–264, 292

[56] References Cited

U.S. PATENT DOCUMENTS

| | | | |
|---|---|---|---|
| 1,192,478 | 7/1916 | Vandercook . | |
| 1,992,261 | 2/1935 | Traudt | 366/137 |
| 2,342,559 | 2/1944 | Sebald et al. | 259/95 |
| 2,522,281 | 9/1950 | Koskinen | 366/173 |
| 3,271,304 | 9/1966 | Valdespino et al. | 210/15 |
| 3,586,294 | 6/1971 | Strong | 259/18 |
| 3,763,039 | 10/1973 | Wilson | 210/6 |
| 3,893,924 | 7/1975 | Le Compte, Jr. et al. | 210/220 |
| 4,097,026 | 6/1978 | Maindl | 366/165 |
| 4,100,614 | 7/1978 | Mandt | 366/154 |
| 4,112,025 | 9/1978 | Wilson et al. | 261/29 |
| 4,146,468 | 3/1979 | Wilson | 209/211 |
| 4,164,541 | 8/1979 | Platz et al. | 422/198 |
| 4,165,285 | 8/1979 | Wind et al. | 210/195.3 |
| 4,166,704 | 9/1979 | Albert | 366/262 |
| 4,206,047 | 6/1980 | Mandt | 210/7 |
| 4,206,052 | 6/1980 | Mandt | 210/49 |
| 4,253,956 | 3/1981 | Pette | 210/188 |
| 4,290,884 | 9/1981 | Mandt | 210/195.3 |
| 4,332,484 | 6/1982 | Peters | 366/137 |
| 4,372,851 | 2/1983 | Mandt | 210/199 |
| 4,416,549 | 11/1983 | Kretschmer | 366/190 |
| 4,512,665 | 4/1985 | Cline et al. | 366/167 |
| 4,576,720 | 3/1986 | Mandt | 210/626 |
| 4,596,658 | 6/1986 | Mandt | 210/626 |
| 4,618,426 | 10/1986 | Mandt | 210/620 |
| 4,812,045 | 3/1989 | Rivers | 366/107 |

FOREIGN PATENT DOCUMENTS

| | | | |
|---|---|---|---|
| 1043481 | 11/1978 | Canada . | |
| 726101 | 10/1942 | Germany . | |
| 395707 | 12/1965 | Switzerland . | |
| 626800 | 8/1978 | U.S.S.R. | 366/137 |
| 734331 | 5/1980 | U.S.S.R. . | |
| 734331 | 5/1980 | U.S.S.R. | 366/137 |
| 1643067 | 2/1989 | U.S.S.R. . | |
| 543995 | 3/1942 | United Kingdom | 366/137 |
| 2058597 | 4/1981 | United Kingdom . | |

OTHER PUBLICATIONS

Written Opinion under PCT Rule 66 dated Apr. 21, 1994 relating to International Application No. PCT/US93/04464.

Trade brochure by A. O. Smith Slurrystore Sludge Storage System entitled, "Side–Mounted Pump and Center Agitation System."

Trade brochure by A. O. Smith Harvestore Systemsentitled, "Deluxe Agitation Nozzle." This brochure bears a copyright notice dated 1985.

(List continued on next page.)

*Primary Examiner*—David Scherbel
*Assistant Examiner*—Terrence R. Till
*Attorney, Agent, or Firm*—Fitch, Even, Tabin & Flannery

[57] ABSTRACT

A method and apparatus for mixing solid and liquid components of a slurry which have settled in a storage tank, suspending the solids in a substantially homogeneous slurry mixture are practiced by directed flow apparatus. A plurality of jet nozzles or propeller mixers is located in the storage tank within an annular band ranging between 25 percent and 75 percent of the radial length from a center of the tank to a tank wall. They are directed either in a tangent direction or at an angle away from the center of the tank to provide a substantially volume-filling mixing flow to suspend the solid slurry component in the liquid slurry component.

11 Claims, 5 Drawing Sheets

OTHER PUBLICATIONS

Trade brochure by A. O. Smith Slurrystore Systems entitled, "The S–Tube Riser."

Trade brochure entitled "Horizontal and Suction Chopper Pumps—HP Series" published by Vaughn Company, Inc. of Montessamo, Wash. dated Dec. 1988.

Trade Brochure describing "Off the Shelf *Lightnin* Mixers," 1 page.

Trade brochure entitled "Model 4450 Submersible Mixer Parts List," pp. 1, 2 and 7, Flyght Corporation, Norwalk, Conn.

Trade brochure entitled "jet pump application guide," 4 pp., published by Penberthy Houdaille, Penberthy Division, Houdaille Industries, Inc., Prophetstown, Ill., Mar., 1976.

Trade brochure entitled "Penberthy Jet Disinfection™: Efficient, effective method of gas/liquid contacting," Form No. PJA–576, Penberthy Houdaille, Water & Waste Water Systems Div., Haudaille Industries, Inc., Cedar Falls, Iowa, copyright date 1975, 11 pp.

Trade brochure entitled "Penberthy Jet Disinfection™: Better kills with less disinfectant, less capital," Penberthy Houdaille, Penberthy Division, Houdaille Industries, Inc., Water and Waste Systems, Prophetstown, Ill. Form No. PJD 475, copyright date 1975.

Trade brochure entitled "Penberthy directional mix jet aeration: the new direction in aeration," (Bul WW3–73), published by Penberthy Houdaille, Water and Water Waste Products, Prophetstown, Ill., 4 pp., copyright 1973.

Trade brochure entitled "Case Studies in waste water treatment progress," (Case study No. 741), 2 pp., published by Penberthy Houdaille, Water and Water Waste Products, Prophetstown, Ill., copyright 1974.

Trade brochure entitled "Penberthy Jet Pump Technical Data: mixing liquids," (Bulletin 1401), 4 pp., published by Penberthy, Div. of Stanwich Industries, Inc., Prophetstown, Ill., issue date Sep. 1987.

Biothane Corporation shop Drawing No. E–11898, "Digester Feed Distribution Piping", Rev. Mar. 2, 1988.

Biothane Corporation shop Drawing No. D–11901, "Feed Distribution Piping Details", Rev. Mar. 2, 1988.

METHOD AND APPARATUS FOR STORING AND HANDLING WASTE WATER SLURRIES

This application is a continuation of application Ser. No. 275,922 filed Jul. 14, 1994, now abandoned, which is a continuation of application Ser. No. 879,602 filed May 7, 1992, now abandoned.

BACKGROUND OF THE INVENTION

The present invention pertains to waste treatment facilities in general, and in particular to long-term storage of slurries.

Liquid sludge storage has been used for agricultural applications. Typically, manure from livestock is stored over a period of time, until conditions are appropriate for land application or other disposition of the stored material. It has been found convenient to store the manure in a liquid form in large open top storage tanks. As those skilled in the art will readily appreciate, the manure, which is fed into the tank in the form of a liquid/solids slurry, will begin to settle and a surface crust will start to form in a relatively short time after introduction in the storage tank. After relatively long storage times, up to six months or more, the contents of the tank must be discharged for application in a field. Due to the settling, and crust formation on the top of the tank, preparations must be made several days ahead of time to prepare the tank contents for discharge using liquid handling devices.

In waste water treatment facilities, such as municipal waste water treatment plants, sludge is processed in various liquid forms and then stored in a dried condition. However, due to environmental considerations, difficulties in handling the sludge during treatment, and other factors, there is a growing interest in storing the sludge in a liquid form.

When liquid sludge storage has been practiced in the past, the contents being stored have been continuously mixed to maintain the sludge solids in suspension. This facilitates withdrawal of sludge with relatively little preparation using liquid handling systems. However, when sludge is stored for a prolonged period of time, on the order of several months or more, the costs of maintaining sludge in a slurry form can be significant. Accordingly, there has been a recent emphasis in exploring cost savings by allowing sludge slurries in long-term storage to settle, and to mix the contents of the storage tank only prior to tank unloading.

As those skilled in the art will appreciate, a crust of substantial thickness can form on the surface of the tank and settling of solid sludge components can be quite pronounced, requiring appropriately distributed mixing energy to be applied to the tank contents so as to complete re-suspension of the solid contents of the tank. It has been found that submerged mixing devices, either of the propeller or gas type, have not been able to effectively mix tanks of larger diameter size particularly when re-suspension of solids is necessary. Fixed propeller-type mixers, either those entering the side or top of the tank provide a substantial mixing energy to the tank contents, but have been found to leave dead spots in the tank which are not mixed. Also, propeller mixers have been found effective only at certain specified water levels.

Diffused aeration systems have been used successfully on some types of mixtures, but have not been capable of re-suspending solids which have settled out of a slurry mixture, and are thus unsuitable for use with long-term sludge storage. U.S. Pat. No. 3,271,304 provides an example of a diffused aeration system.

Fixed liquid jets have been installed in storage tanks, and have been found to create a velocity sufficient to maintain solids in suspension and to re-suspend solids in the flow path. However, in practical applications, portions of the tank, oftentimes the center of the tank bottom, have been found unmixed. Also, fixed liquid jets as previously employed, have not been able to break up a crust formed on the top of the storage tanks. U.S. Pat. No. 3,586,294 shows an example of fixed liquid jets. The jets are fed from a header system located at the bottom of the storage tank, and produce counter-rotating flows. U.S. Pat. No. 4,416,549 discloses an arrangement for mounting a pump at the bottom of a storage tank, and includes a mounting arrangement for attachment to the outer wall of the tank.

Pivoting propeller mixers have been installed along tank sidewalls. In general, pivoting propeller mixers have been able to generate velocities necessary to re-suspend solids along the outer portion of the tank, but contents at the center of the tank have not been re-suspended.

Certain improvements have been provided by the arrangement of U.S. Pat. No. 4,332,484 which employs a rotatable liquid jet nozzle located at the center of a storage tank. A second nozzle is located above the water level of the tank and is manually directed to break up the top crust which forms on the tank, and to clean off the tank walls after the tank has been emptied. The centrally located rotatable nozzle is positioned adjacent the tank floor and applies velocity at a point where solids are accumulated.

In order to break up the crust formed at the upper surface of the tank contents, U.S. Pat. No. 4,512,665 provides an adjustable nozzle mounted at the top of the tank for discharging a flow downwardly on top of the crust to break up the crust in preparation for homogenization of the crust pieces by other systems.

SUMMARY OF THE INVENTION

It is an object according to the present invention to provide method and apparatus for improved mixing of slurries, in particular waste water slurries or manure slurries in storage tanks.

Another object according to the present invention is to provide method and apparatus of the above-described type which provides an improved energy distribution of an agitating flow generated in a storage tank.

Yet another object according to the present invention is to provide methods and apparatus for agitating the contents of a sludge storage tank to suspend settled solids, and also to break up crusts which form on the tank contents, and a related object is to provide these advantages with a minimum number of submerged flow generating units without requiring mixing units generating flows outside of the tank contents.

These and other objects according to the present invention which will become apparent from studying the appended description and drawings are provided in apparatus for storing a slurry having solid and liquid components, comprising a storage tank defining a volume for holding the liquid and solid slurry components, including a floor of generally circular configuration and having a center portion, the storage tank further including an outer surrounding wall positioned generally at a preselected radial distance from the center portion, and at least two flow generating means positioned to be submerged within the liquid and solid slurry components for generating flow of at least one of the slurry components along a preselected direction, the flow generating means being disposed only at distances from the center portion ranging between approximately 25 percent and 75 percent of the preselected radial distance the flow generating means creating a substantially volume filling flow of at least one of the slurry components within the storage tank which mixes the liquid and solid slurry components to form a substantially homogenous slurry suitable for unloading from the storage tank using liquid handling devices.

DETAILED DESCRIPTION OF THE PREFERRED EMBODIMENTS

Referring now to FIGS. 1–6, a first embodiment of an apparatus 8 according to principles of the present invention is shown. The apparatus 8 includes a storage tank 10 of generally cylindrical, open top construction, for holding a wide variety of materials, especially slurries having liquid and solid components. The present invention has found immediate commercial acceptance for holding liquid sludge of the manure slurry, and especially the waste water treatment types. Storage tank 10 has an upstanding wall 12 and a circular floor 14, preferably of flat, generally horizontal construction. The storage tank 10 is preferably of cylindrical form, but can have other configurations such as sidewalls having multiple, non-continuous side portions (such as an octagon, for example) and the floor 14 could be of slightly conical configuration with the tip of the cone pointing either upward or downward. The storage tank 10 is preferably constructed above ground, but can also be constructed below grade, if desired.

Figure 7:
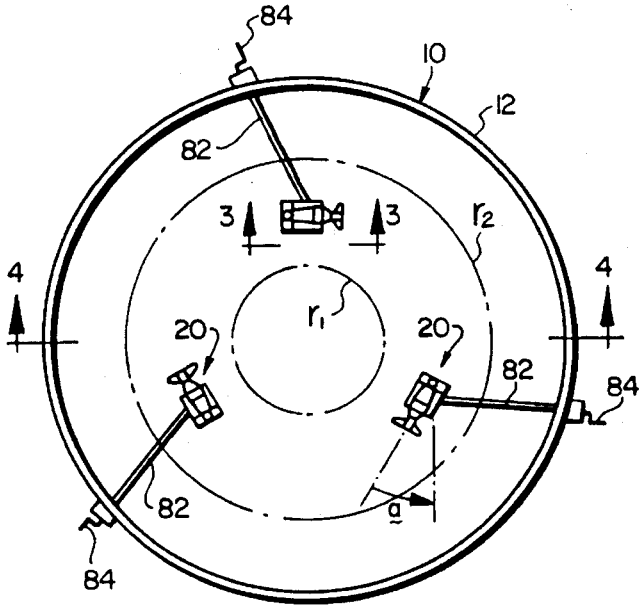
FIG. 7 is a top plan view of an alternative embodiment.
Figure 8:
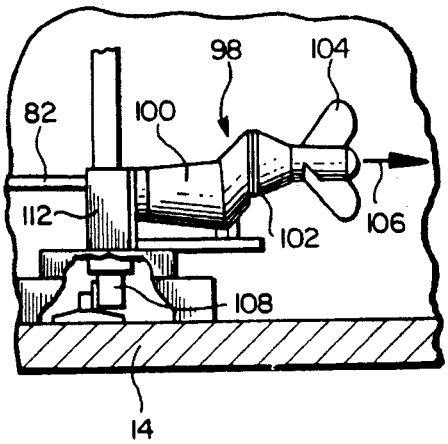
FIG. 8 shows a fragmentary portion of FIG. 7 in elevation, on an enlarged scale.

Disposed within the storage tank 10 is a plurality of flow generating means comprising flow devices of the type having directed flow output. The flow devices can have any form are positioned within the storage 10 to be partly or wholly submerged in at least one of the liquid and solid components of the slurry. The flow devices 20 direct output flow generally along a line or over a relatively narrow angle of dispersion, at least at the outputs of the devices. Flow devices of the preferred embodiments are of the jet nozzle or discharge nozzle type and the propeller mixer type. FIGS. 1–6 show an embodiment of three jet nozzle or discharge nozzle units 20, while FIGS. 7 and 8 show flow devices of the propeller mixer type. In the first preferred embodiment, the jet nozzle units 20 have portions that are rotatable in generally horizontal planes so as to change the direction of directed flow output from the units, as will be explained herein. With additional reference to FIGS. 3 and 4, the jet nozzle units 20 each include a jet nozzle or discharge nozzle, generally indicated at 24, and include an inlet connection 26, preferably in the form of a housing mounted to the circular tank floor 14. The inlet connection 26 is coupled through a pipe 28 to a suitable source of high pressure flow indicated by arrows 30 in FIGS. 3 and 4. The pipe 28 extends through the wall 12 of the storage tank 10 to facilitate maintenance or modification of the high pressure source 29. Referring to FIG. 2, one example of the high pressure source 29 is illustrated as including a plurality of pumps 34, preferably of a comminuting or chopping type, receiving flow from a center sump 36 located within the storage tank 10 and coupled to a header 40 by a pipe 42. An optional second or peripheral sump 44 is coupled to a header 40 by a pipe 46. A pair of valves, respectively numbered 48 and 50, control flow into the header 40. The header 40 includes an inlet portion 52 for receiving a flow of makeup water, schematically indicated by arrow 54, which can be used to add water or other fluid to the storage tank 10, as desired. Each pump 34 has associated with it a valve 58 coupling the pump 34 to an outlet header 60. A valve 62 couples the outlet header 60 to the inlet connections 26 through the pipes 28. Flows to each of the inlet connections 26 are controlled by respective valves 66.

Discharge of the slurry components from the storage tank 10 may be accomplished in a number of different, suitable ways. For example, a valve 70 allows discharge in the direction of an arrow 72. It may be desirable during such discharge that the valve 62 be closed to route maximum pumping power through the valve 70 so as to direct the slurry components through piping or to vehicles for further processing or disposition at a remote location.

In the preferred embodiment, a closed loop flow-through mode of operation is employed for mixing and suspending the slurry components with the slurry components being withdrawn from the storage tank 10 via the center sump 36 and the peripheral sump 44 in the storage tank 10 and directed through the manifolds and the pumps 34 to be returned to the storage tank 10 through the jet nozzles 24.

Figure 3:
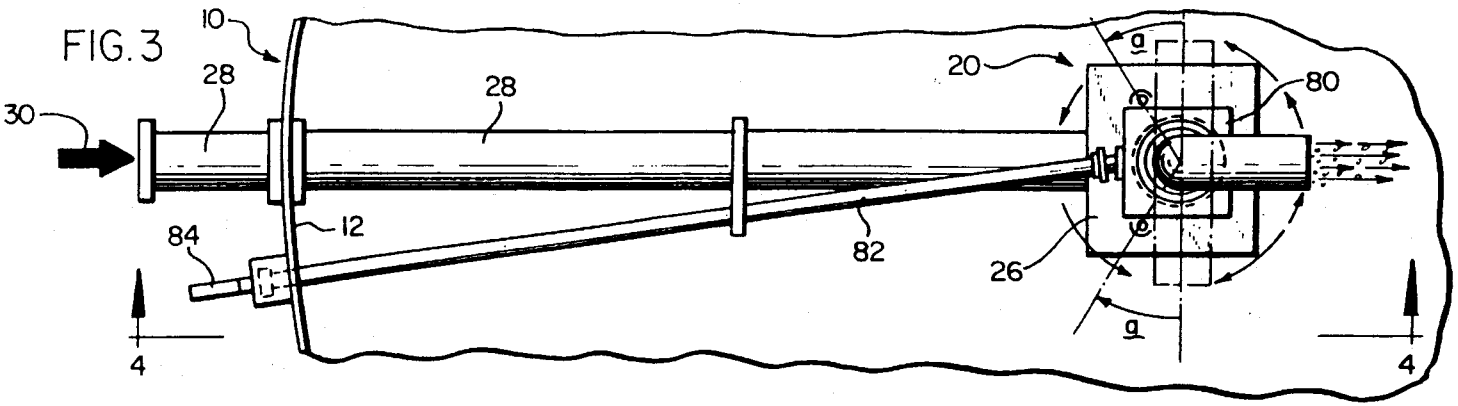
FIG. 3 is a fragmentary view taken along the line 3—3 of FIG. 2 shown on an enlarged scale.
Figure 4:
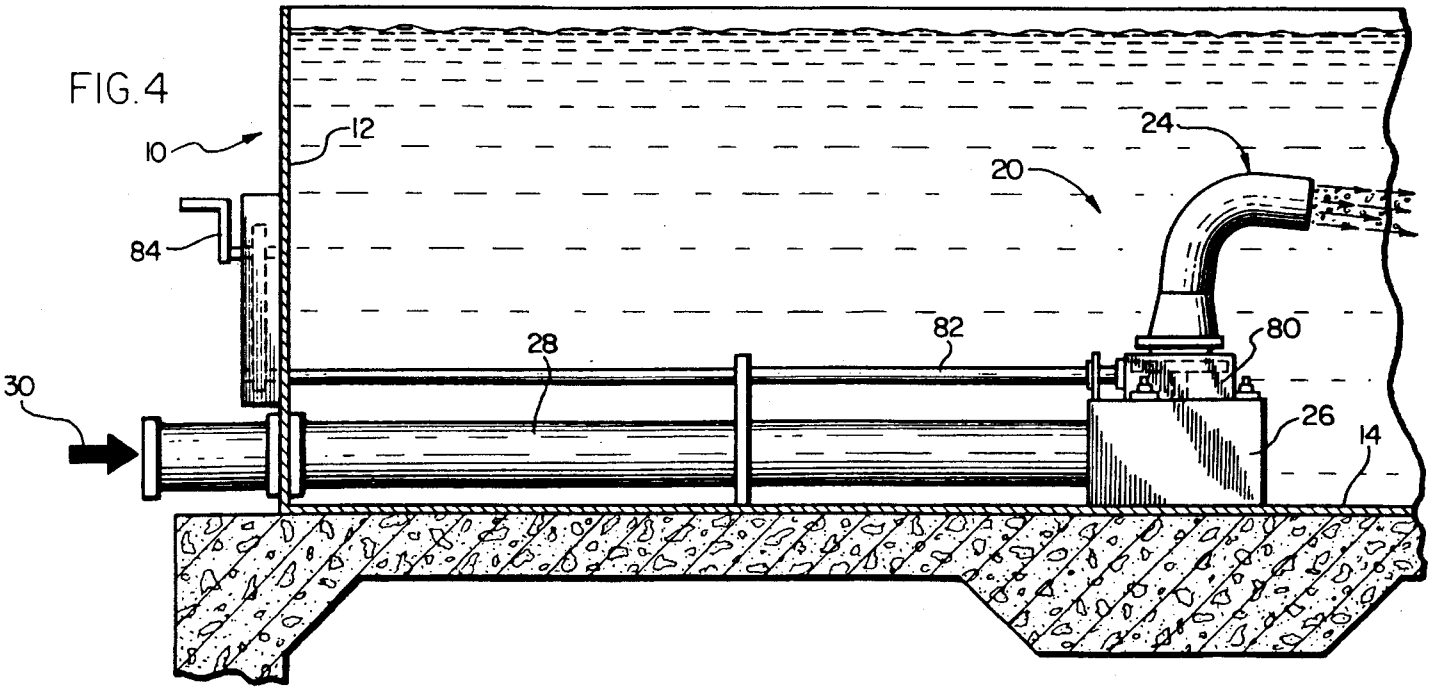
FIG. 4 is a cross-sectional view taken along the line 4—4 of FIG. 3.

Referring again to FIG. 1 and to FIGS. 3 and 4, the jet nozzle units 20 further include devices for changing the direction of flow by positioning the jet nozzles 24, which are preferably in the form of a gear box 80 mounted atop the inlet connections 26 and driven through transmission shafts 82 by manually operated cranks 84 located outside of tank 10. The jet nozzle units 20 are preferably of a type disclosed in U.S. Pat. No. 4,332,484 (herein incorporated by reference) and commercially available from A. O. Smith, as part of its Slurrystore sludge storage systems. As indicated in FIG. 3, the jet nozzles 24 may be continuously rotated and such is helpful for cleaning the storage tank 10 after the contents have been removed. However, it is generally preferred during operation when contents of the storage tank 10 are being re-suspended into a homogeneous composition, that the jet nozzles 24 be directed away from the tank center, being operated throughout an acute angle a ranging between 0° and 60° as measured from a line perpendicular to a radius from the center C of the storage tank 10, and extending through the flow device 20.

Figure 1:
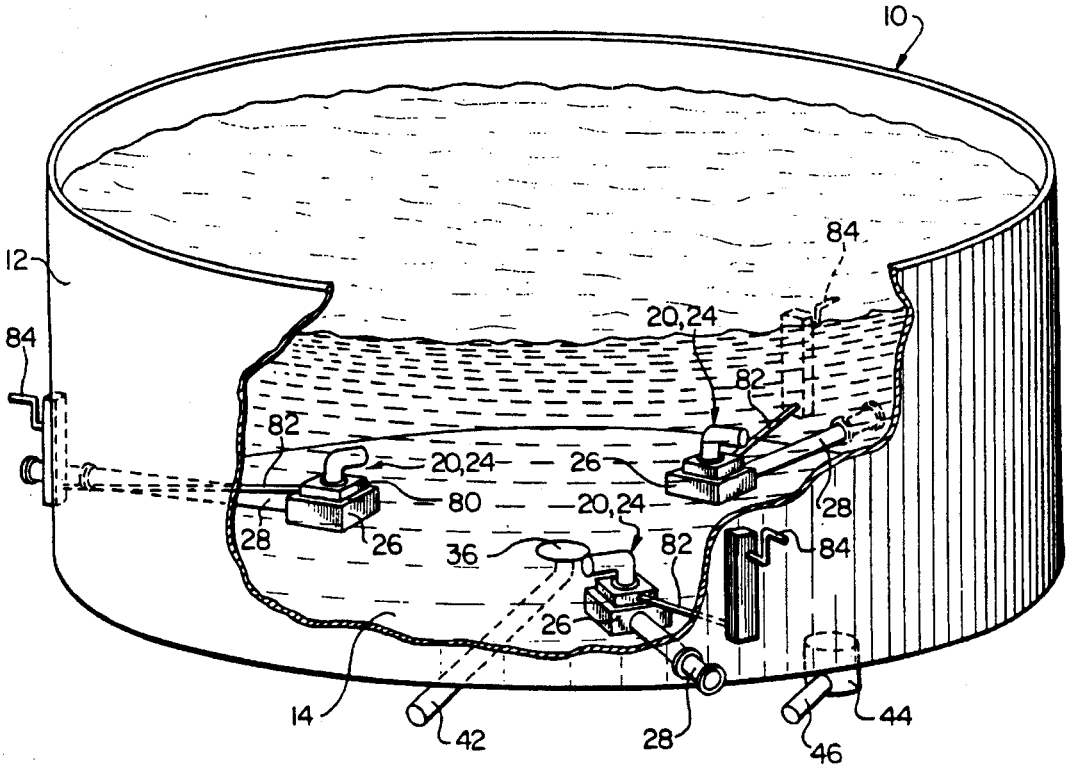
FIG. 1 is a perspective view, shown partly cut away, of apparatus according to principles of the present invention.
Figure 2:
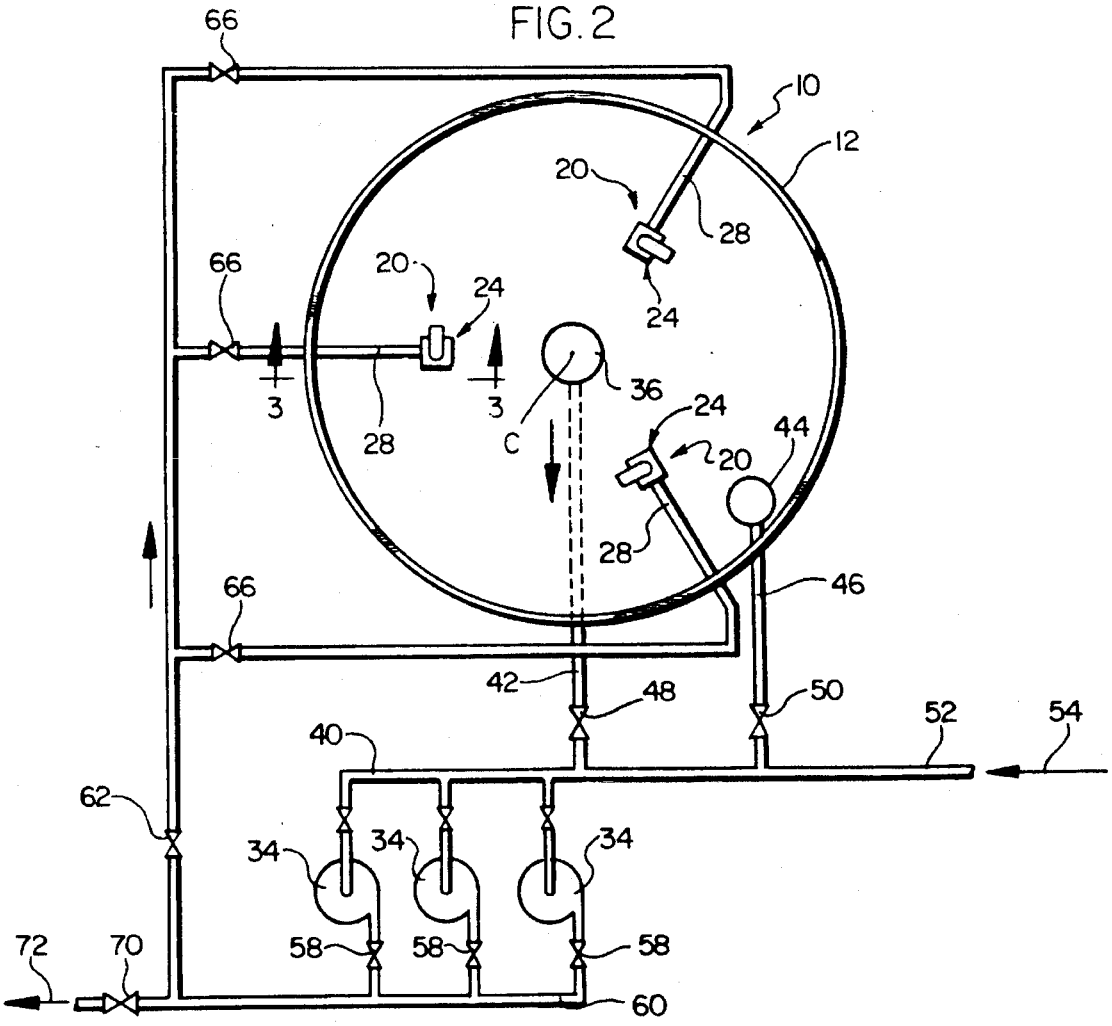
FIG. 2 is a top plan view thereof in schematic form.

As indicated in FIGS. 1 and 2, for example, it is generally preferred that all jet nozzles 24 of a system are all directed in the same rotational sense. For example, as can be seen in FIG. 2, an overhead plan view, the jet nozzles 24 are all directed in a clockwise direction. FIG. 2 shows the jet nozzles 24 all directed along tangent lines, although as mentioned above, the jet nozzles 24 can be angled slightly outwardly away from the tank center C and as will be seen herein, a surprising improvement in mixing the center of the storage tank 10 is achieved even though the jet nozzles 24 are angled away from, rather than toward, the tank center C.

As can be seen in FIG. 2, the jet nozzles 24 are located at equal radial lengths from the tank center line C. According to an important aspect of the present invention, the jet nozzles 24 are located within an annular band ranging between 25 percent and 75 percent, and more preferably between 30 percent and 70 percent of the radial distance from the tank center C to the tank wall 12. Multiple "rings" of jet nozzles 24 can be employed within the annular band, or less preferably, the jet nozzles 24 can be located at varying distances from the tank center C. Although the preferred tank configuration is cylindrical, the present invention may also be adapted for use with slightly out-of-round tanks, as well as with octagonal and other multi-sided tanks, in which case the aforementioned annular band is measured with respect to a "radius" corresponding to the average distance between the center of the tank and the tank wall sides.

As shown in the figures, the flow devices, whether of the propeller type or jet nozzle type, are all located at equal radial lengths, although the flow devices of any one particular system could be located at different radii falling within the aforementioned annular band. Further, the figures show the flow devices all point in the same direction with respect to tangents to the flow device radius, although the flow devices could point in different directions, and such may be desirable for certain tank sizes and aspect ratios. However, it is preferred that the flow devices have directed outputs ranging within the limits of angle a, as described above.

Further, the flow devices illustrated in the figures are all equally spaced and, while such is the preferred arrangement, the flow devices could be unequally spaced for tanks of certain size and aspect ratios. For example, flow devices may be grouped in pairs of differently directed devices, and such is contemplated by the present invention. Other alternative arrangements will become apparent upon studying the description and drawings.

Figure 5:
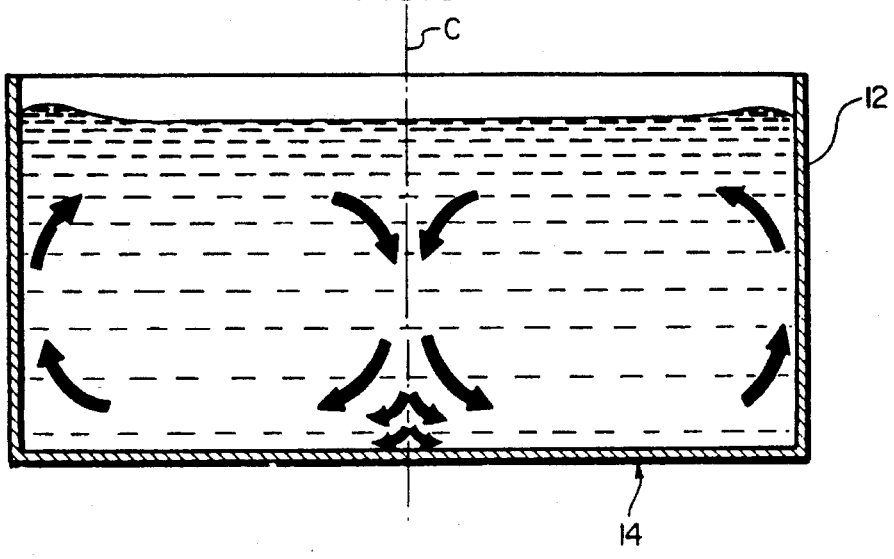
FIG. 5 is a diagrammatic view showing the flow pattern within the tank.
Figure 6:
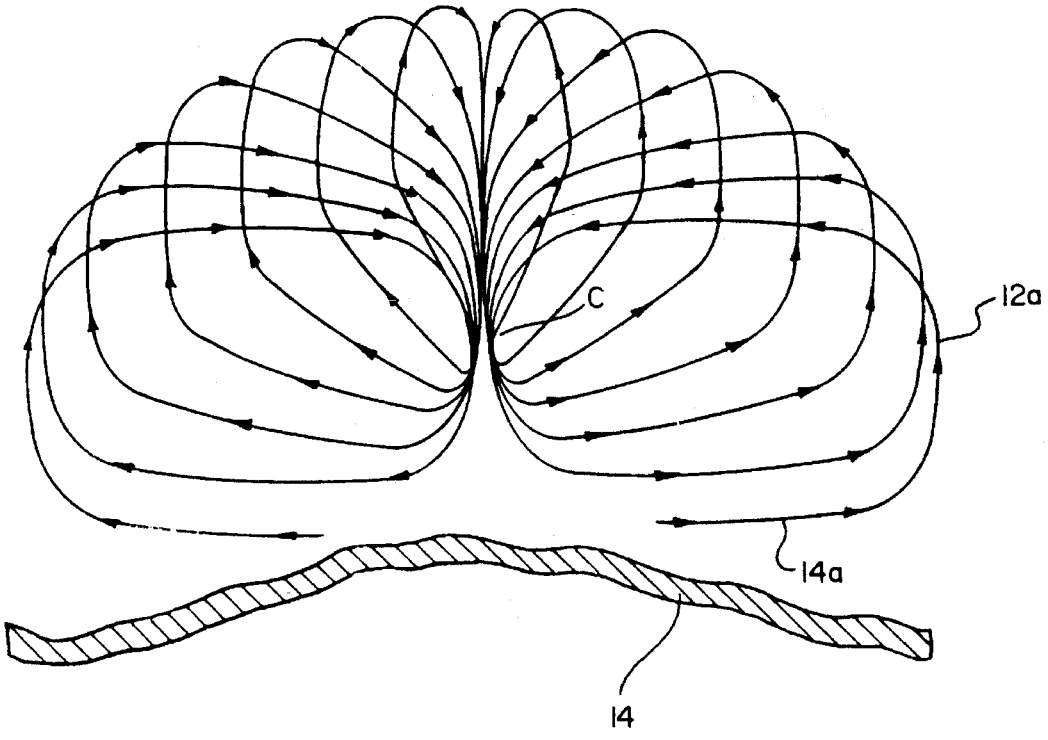
FIG. 6 is a diagrammatic perspective view of the flow pattern.

Referring now to FIGS. 5 and 6, arrangements of submerged flow devices within the annular band described above, have been found to produce surprising results including substantially volume-filling flow which has been found to maintain suspension and even more surprisingly, remix into homogeneous suspension substantially the entire contents of the tank. Notably, the present invention has been found to thoroughly maintain in suspension and if necessary, remix contents located at the center line C of the storage tank 10. As illustrated in FIG. 5, flow is directed along the outside wall 12 of the storage tank 10, across the surface of the slurry components in the storage tank 10 and downwardly along the tank center C. The flow then sweeps across the tank floor 14, especially at the point where the vertical center line C intersects the tank floor 14. Further, flow produced according to principles of the present invention is believed to be substantially helical, sweeping out an annular volume having a negligible central radius and an outer radius corresponding to that of the tank wall 12, as illustrated in FIG. 6. The flow lines of FIG. 6 include flow components **14*a* travelling across the tank floor 14, and flow components 12*a* sweeping along the tank wall 12, and returning downwardly at the center C of the storage tank 10**. The resulting flow patterns create an intensive mixing at the center of tank by creating a vortex-like characteristics therein. In some cases a true vortex is created at the tank center, depending upon the viscosity of the slurry and/or its components.

As mentioned, the present invention, with submerged flow devices located in the annular band defined above, provides surprisingly thorough mixing of tank contents, even slurry compositions which have heretofore been difficult to handle. Examples of such slurry compositions contemplated by the present invention are manure solutions, waste water and waste slurries for industrial plants. The slurries also comprise those processed by water treatment plants, including municipal water treatment plants and municipal and/or industrial waste water treatment plants. Quite surprisingly, the present invention dramatically reduces the time required to remix i.e., re-suspend slurries which have settled over prolonged storage periods, on the order of several months or more. As those skilled in the art will appreciate, it has been difficult, heretofore, to completely mix manure storage tanks which have been allowed to settle over prolonged periods of time, using only submerged flow devices. Difficulties have been encountered in suspending solids which have accumulated on the tank floor, especially near the center of the tank floor. The present invention provides an energy distribution which accomplishes re-suspension of solids at the center of the tank floor, in a surprisingly short time.

Further, those skilled in the art readily appreciate that waste water tanks and manure slurry storage tanks form crusts of substantial thickness and mechanical strength when tank contents are allowed to settle, without continuous agitation over prolonged periods of time. The formation of such crusts, along with difficulties in remixing solids at the tank floor have heretofore prevented manure and waste water storage systems which do not require energy input during prolonged storage periods. With the present invention, crusts even those of substantial thickness associated with prolonged storage periods, are broken up and suspended into a substantially homogeneous slurry in a surprisingly short time. With the present invention, the crusts formed on such tanks, even over prolonged periods on the order of 6 months, (e.g., crusts having a thickness of six inches or more) are completely re-suspended into a homogeneous slurry in times as short as two days, with flow rates as flow as 3 to 5 lineal feet per second. In the prior art, minimum energy levels of 50 to 75 brake horsepower per 1,000,000 gallons of tank volume were required to turn over the contents of the tank volume. In the present invention, the same results can be achieved using as little as 25 to 30 brake horsepower per 1,000,000 gallons of tank volume.

Referring now to FIGS. 7 and 8, an alternative embodiment is shown using a different type of flow device, preferably comprising conventional propeller mixers 98 of the type commercially available from Flygt Corporation and others. The preferred propeller mixers 98 are of the submerged motor type, and include drive motors 100 and transmissions 102 driving a propeller blade 104 mounted about an axis of rotation generally aligned with the direction of flow output indicated by arrow 106 in FIG. 8. The propeller mixers 98 preferably include a pivoting mounting 108 extending in a generally vertical direction so that the propeller directed output may be swung about a horizontal plane. The propeller mixers 98 further include a gear box 112 driven by transmission shaft 82. Because of the electrical connections to the drive motors 100, it is generally preferred that the propeller mixer's rotation be limited to avoid the need for rotatable wiping contacts for the electrical connections. As with the preceding embodiment, it is preferred that the propeller mixers 98 be rotatable away from the tank center over an acute angle a ranging between 0° and 60° as measured with respect to a line normal to the radius passing through the propeller mixer device. As with the jet nozzle units described above, the propeller mixers produce a directed flow, or pressurized output stream directed along an axis line, at least in areas located at the mixer output. It is generally preferred that the outputs of the flow devices have a relatively small dispersion angle so as to provide the defined flow paths described above with reference to FIGS. 5 and 6, for example. Propellers driven by motors located outside of the slurry may also be used. If desired, the flow devices used with the present invention can be fixed, i.e., not rotatable.

Figure 9:
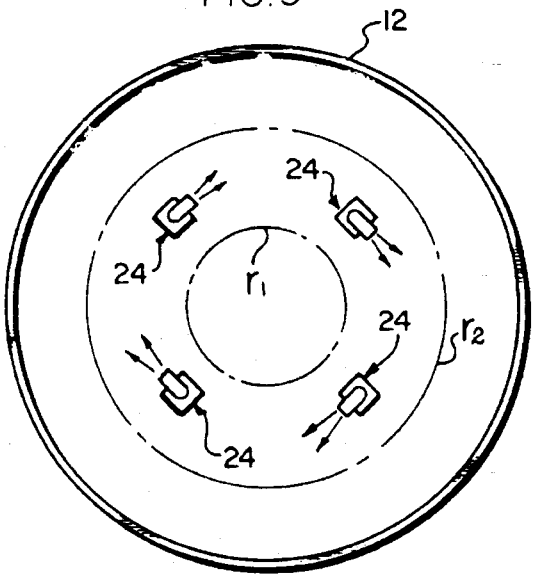
FIGS. 9 and 10 are top plan views of other alternative embodiments.

Referring now to FIG. 9, a further alternative embodiment according to principles of the present invention will be described. Thus far, the mixing arrangements have consisted of groupings of three flow devices. In FIG. 9, four flow devices are employed to produce the flow patterns described above with reference to FIGS. 5 and 6, for example. The flow devices illustrated in FIG. 9 are of the jet nozzle type, but also could be of the propeller mixer type, if desired. The jet nozzles 24 are located along a common radius, are pointed with the same rotational sense and are spaced equidistant from one another although, as mentioned above, other arrangements differing from that illustrated are also possible. FIG. 9 indicates the aforementioned annular band within which the flow devices are located. In FIG. 9, the annular band has an inner limit $r_1$ and an outer limit $r_2$ ranging between 25 percent and 75 percent, and more preferably between 30 percent and 70 percent of the radial distance to tank wall 12.

Figure 10:
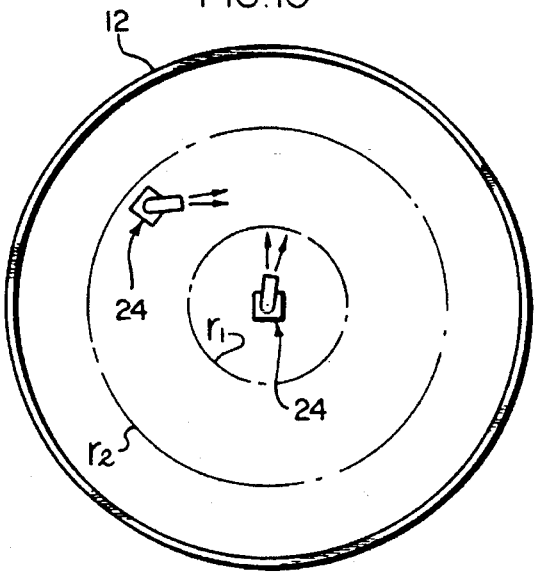

Referring now to FIG. 10, a further alternative embodiment is illustrated using two flow devices, such as jet nozzles 24. In FIG. 10, one jet nozzle 24 is located at the center of the storage tank 10, while the second jet nozzle 24 is located within the annular band defined by principles of the present invention. FIG. 10 shows a minimum number of flow devices required to produce the flow patterns described above with reference to FIGS. 5 and 6, for example. The jet nozzle 24 located in the annular band may have to be pointed slightly toward the tank center C as illustrated, for some tanks, although it is generally preferred that it be pointed away from the tank center for most applications.

Figure 11:
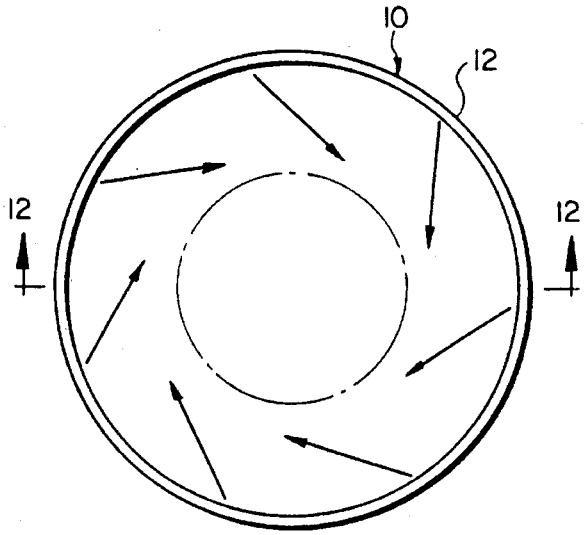
FIG. 11 PRIOR ART
FIG. 11 is a diagrammatic plan view of a prior art system.
Figure 12:
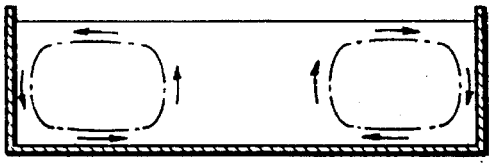
FIG. 12 PRIOR ART
FIG. 12 is a cross-sectional view taken along the line 12—12 of FIG. 11.

Referring now to FIGS. 11 and 12, a prior art flow pattern is schematically indicated for tank mixing systems having flow devices located adjacent a tank wall 119. An example of such an arrangement employs propeller mixers mounted to the tank wall 119 for stabilization and ready maintenance. One problem encountered with such an arrangement is that the center of the tank, that area located within the dot-dash inner circle of FIG. 11, experiences greatly diminished and oftentimes negligible mixing. An increase in the number and power of the mixing units has not been found effective in overcoming the observed difficulties in thorough mixing, which alone are provided by systems according to principles of the present invention.

FIG. 12 shows a cross-sectional view of flow through the tank in which the unmixed central core of the tank is evident. Thus, although substantial amounts of flow energy are imparted to the contents of the tank, the energy is not distributed as in the present invention and as a result, solids accumulate at the tank center.

Figure 13:
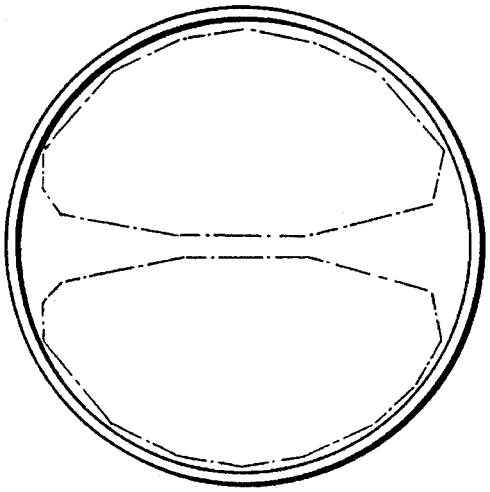
FIG. 13 PRIOR ART
FIGS. 13–15 are top plan views of prior art systems.
Figure 14:
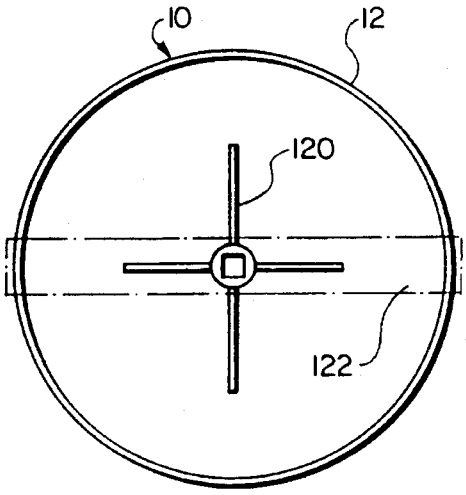
FIG. 14 PRIOR ART
Figure 15:
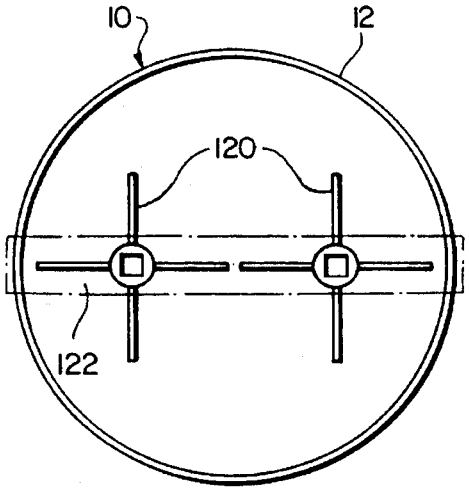
FIG. 15 PRIOR ART

FIG. 13 shows another flow pattern experienced with prior art mixing systems, again showing a non-uniform energy distribution, and flow patterns which are not substantially volume-filling as in the present invention. In FIG. 13, the flow patterns are limited to two lobes separated from one another by a strip of poor or negligible mixing. The flow pattern of FIG. 13 may result from the dual paddle mixer arrangements schematically indicated in FIG. 15. In FIG. 15, a pair of paddle assemblies 120 is located on an overhead suspension member 122, stretching across the top of a storage tank 123. FIG. 14 shows a single paddle mixer which also has been found inadequate to mix tank contents, particularly at portions of a tank floor adjacent the tank wall 125.

As can be seen from the above, the present invention employs flow devices, submerged or not, having submerged directed flow outputs, which are located within an annular band located between 25 percent and 75 percent and most preferably between 30 percent and 70 percent of the radial distance from the center of the storage tank to the tank outer wall. The annular band may also be determined for non-cylindrical tank walls having multiple sides of uniform construction, such as octagons, hexagons and the like or out-of-round configurations. The directed flows from the flow devices are preferably angled within an acute angle directed away from the tank center, the angle being measured with respect to a tangent to the flow device radius. The acute angle ranges between 0° (i.e., normal to the tank radius) and 60°, and varies for tanks of differing sizes and aspect ratios. It is preferred that flows according to principles of the present invention be set up so as to have downwardly directed components at the center of the tank, although upwardly directed components at the tank center are also possible and are contemplated by the present invention.

It is preferred that the flow devices be located at generally the same height with respect to the tank floor. However, the various flow devices of a system may be installed at differing heights, if desired.

While it is generally preferred that the same type of flow device, preferably either a propeller mixer or jet nozzle, be employed throughout a given system, the flow device types can be mixed in a given system if desired, and may be combined in pairs to achieve desired flow patterns.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following Claims.

What is claimed is:

1. Apparatus for storing a slurry having solid and liquid components, comprising:

a storage tank defining a volume for holding a body of liquid and solid slurry components, including a floor of generally circular configuration and having a center, said storage tank further including an outer surrounding wall positioned generally at a radial distance from the center;

at least two flow generating means positioned to be submerged within the liquid and solid slurry components for generating flow of at least one of the slurry components along a rotational direction, each of said flow generating means being disposed at distances from the center ranging between approximately 30 percent and 70 percent of said radial distance;

each of said first and second flow generating devices pointed in the direction for generating flows of the liquid and solid components from the respective flow generating means directed in the same rotational sense, said first and second flow generating means being directed at an angle to the radius to generate flows with tangential components of flow to impart a rotational movement of the entire body of liquid and solid components;

each of said first and second flow generating means being pointed toward the outer surrounding wall for generating a substantial helical flow path of the liquid and solid components therein with the liquid and solid components traveling outwardly, across the tank floor from the center portion of the tank toward the tank wall and then upwardly along the tank outer surrounding wall to a first point and then inwardly along an upper portion of the body toward the center of the tank and then downwardly toward the tank floor, and then outwardly to a second point spaced circumferentially in the direction of rotation of the entire body of liquid, the liquid and solid components continuing to travel in the helical path as the entire body of liquid and solid components continues to rotate;

a pressure source coupled to the first and second flow generating means to generate directed streams from the flow generating means to rotate the body of liquid and solid components and to cause the flow in the helical path; and said flow generating means creating a substantially volume filling flow of at least one of the slurry components within said storage tank which mixes the liquid and solid slurry components to form a substantially homogeneous slurry suitable for unloading from said storage tank using liquid handling devices.

2. Apparatus for storing a slurry having solid and liquid components as defined in claim 1 wherein one of said flow generating means comprises a discharge nozzle, the flow along the direction generated by said discharge nozzle comprising a jet stream of flow of at least one of the liquid and solid slurry components in the preselected direction.

3. Apparatus for storing a slurry having solid and liquid components as defined in claim 2 further comprising means for coupling said discharge nozzle to the pressure source.

4. Apparatus for storing a slurry having solid and liquid components as defined in claim 3 further comprising sump means coupled to said pressure source for directing at least one of the liquid and solid slurry components to said pressure source, to form a substantially closed loop path for circulating at least one of the liquid and solid slurry components within said storage tank.

5. Apparatus for storing a slurry having solid and liquid components as defined in claim 3 further comprising movable mounting means for movably mounting at least one of said flow generating means within said storage tank so as to selectively change the flow direction thereof.

6. Apparatus for storing a slurry having solid and liquid components as defined in claim 5 wherein said movable mounting means directs the flow direction of said flow generating means away from the tank center portion.

7. Apparatus for storing a slurry having solid and liquid components as defined in claim 1 further comprising a third flow generating means disposed within said storage tank for generating flow of at least one of the slurry components along a direction; and means for selectively controlling the discharge of said flow generating means.

8. Apparatus for storing a slurry having solid and liquid components and for mixing the solid and liquid slurry components to form a substantially homogeneous slurry, comprising:

a storage tank for holding a body of solid and liquid slurry components, said storage tank including a floor of generally circular configuration and having a center, said storage tank further including an outer surrounding wall positioned generally at a radial distance from the center; and at least a first and a second flow generating means for submersion within the solid and liquid slurry components for generating flows of the solid and liquid slurry components along respective directions, said flow generating means each being located at a position in a range between less than 75 percent of said preselected radial distance from the center of said storage tank and greater than 25 percent of said radial distance from the center of said storage tank;

the first and second flow generating means being directed toward the tank outer surrounding wall and an angle to a radius of the tank to provide a substantial tangential flow to impart a rotational movement of the body of liquid and solid components;

a pressure source connected to the first and second flow generating means to generate directed streams from the flow generating means to generate a substantially helical flow path of liquid and solid components with the latter traveling outwardly across the tank floor, and then upwardly along the tank wall, and then along an upper portion of the body, and then inwardly toward the center of the tank, and then downwardly at the center portion of the tank and again outwardly toward a point on the tank wall spaced in the direction of rotation of the entire body to mix the solid and liquid slurry contents to form a substantially homogeneous slurry.

9. Apparatus for storing a slurry having solid and liquid components and for mixing the solid and liquid slurry components to form a substantially homogenous slurry suitable for unloading using liquid handling devices as defined in claim 8 further comprising movable mounting means for movably mounting said first flow generating means within said storage tank so as to selectively change the flow direction thereof.

10. Apparatus for storing a slurry having solid and liquid components and for mixing the solid and liquid slurry components to form a substantially homogenous slurry suitable for unloading using liquid handling devices as defined in claim 9 further comprising movable mounting means for movably mounting said second flow generating means within the storage tank so as to selectively change the flow direction thereof.

11. Apparatus for storing a slurry having solid and liquid components and for mixing the solid and liquid slurry components to form a substantially homogenous slurry suitable for unloading using liquid handling devices as defined in claim 10 wherein said movable mounting means directs the flow direction of said flow generating means away from the tank center portion.

* * * * *